US006799553B1

(12) United States Patent
Takenaka et al.

(10) Patent No.: US 6,799,553 B1
(45) Date of Patent: Oct. 5, 2004

(54) VARIABLE VALVE TIMING CONTROLLER

(75) Inventors: Akihiko Takenaka, Anjo (JP); Haruyuki Urushihata, Chiryu (JP); Hideji Tani, Hashima-gun (JP); Hideji Yoshida, Hashima (JP); Takayuki Inohara, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 10/809,706

(22) Filed: Mar. 26, 2004

(30) Foreign Application Priority Data

Mar. 28, 2003 (JP) ..... 2003-092126
Nov. 18, 2003 (JP) ..... 2003-388000

(51) Int. Cl.[7] ..... F02D 13/04

(52) U.S. Cl. ..... 123/321; 123/322; 123/83; 123/192.1

(58) Field of Search ..... 123/90.1, 188.1, 123/188.4, 192.1, 83, 321, 322

(56) References Cited

U.S. PATENT DOCUMENTS 6,129,061 A * 10/2000 Okuda et al. ..... 123/90.17
6,158,405 A * 12/2000 Masberg et al. ..... 123/192.1
6,487,998 B1 * 12/2002 Masberg et al. ..... 123/192.1

FOREIGN PATENT DOCUMENTS

| | | |
|---|---|---|
| JP | U-4-105906 | 9/1992 |
| JP | 9-264110 | 10/1997 |
| JP | 10-153104 | 6/1998 |
| JP | 11-107718 | 4/1999 |

* cited by examiner

*Primary Examiner*—Bibhu Mohanty
(74) *Attorney, Agent, or Firm*—Nixon & Vanderhye P.C.

(57) ABSTRACT

The variable valve timing controller controls the valve timing of the intake valve. The variable valve timing controller has a shaft, the stator fixed on the engine and generating the magnetic field around the shaft and rotational phase converter converting the torque applied to the shaft. When the valve timing is in the most delayed timing, the engine can be started. The rotational phase of this timing is called the feasible phase. When the stator stops generating the magnetic field, the load torque arise on the shaft. The rotational phase converter varies the rotational phase into the feasible phase with receiving the load torque from the shaft.

12 Claims, 15 Drawing Sheets

VARIABLE VALVE TIMING CONTROLLER

CROSS REFERENCE TO RELATED APPLICATION

This application is based on Japanese Patent Application No. 2003-92126 filed on Mar. 28, 2003 and Japanese Patent Application No. 2003-388000 filed on Nov. 18, 2003, the disclosure of which are incorporated herein by reference.

FIELD OF THE INVENTION

The present invention relates to a variable valve timing controller that changes opening and timing of intake valves and/or exhaust valves of an internal combustion engine according to operating condition of the engine. The opening and closing timing is referred to as valve timing, the variable valve timing controller is referred to as the VVT controller, and the internal combustion engine is referred to as an engine hereinafter.

BACKGROUND OF THE INVENTION

The VVT controller is disposed in a torque transfer system which transfers the torque of the driving shaft of the engine to the driven shaft which opens and closes at least one of an intake valve or an exhaust valve. The VVT controller adjusts the valve timing of the valves by varying a rotational phase of the driven shaft to the driving shaft.

One of the conventional VVT controller varies the rotational phase by oil pressure. In such a VVT controller, it may be difficult to precisely control the oil pressure when it is under the sever condition such as low temperature and just after engine starting.

JP-U-4-105906 shows a VVT controller which varies the rotational phase of the driven shaft against the driving shaft by an electric motor. A stator of the electric motor makes a magnetic field which applies a torque to a motor shaft, and the torque is transmitted to a planetary gear mechanism to vary the rotational phase.

In this type of the VVT controller, when the magnetic field is not formed due to the electrical shorting or break of the stator coil, it is impossible to control the rotational phase by the planetary gear mechanism. Thus the rotational phase of the driven shaft may shift to the phase wherein it as impossible to start the engine.

SUMMARY OF THE INVENTION

The present invention is made in view of the above matters, and it is an object of the present invention to provide the VVT controller which can start the engine even in case of trouble.

If the stator fails to form magnetic field, a resistant torque arises on the motor shaft. Receiving the resistant torque, a phase converter shifts the rotational phase of the driven shaft toward the safety phase in which the engine can be started. Thus, even if the magnetic field is not formed due to the electrical shorting or break of the stator coil, the phase shift from the phase wherein the engine can be started into the phase wherein the engine can not be started is prevented.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT (First Embodiment)

Figure 1:
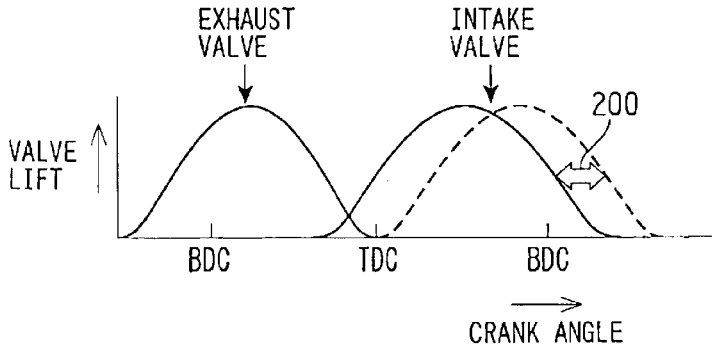
FIG. 1 is a characteristic diagram for explaining the function of the VVT controller.
Figure 2:
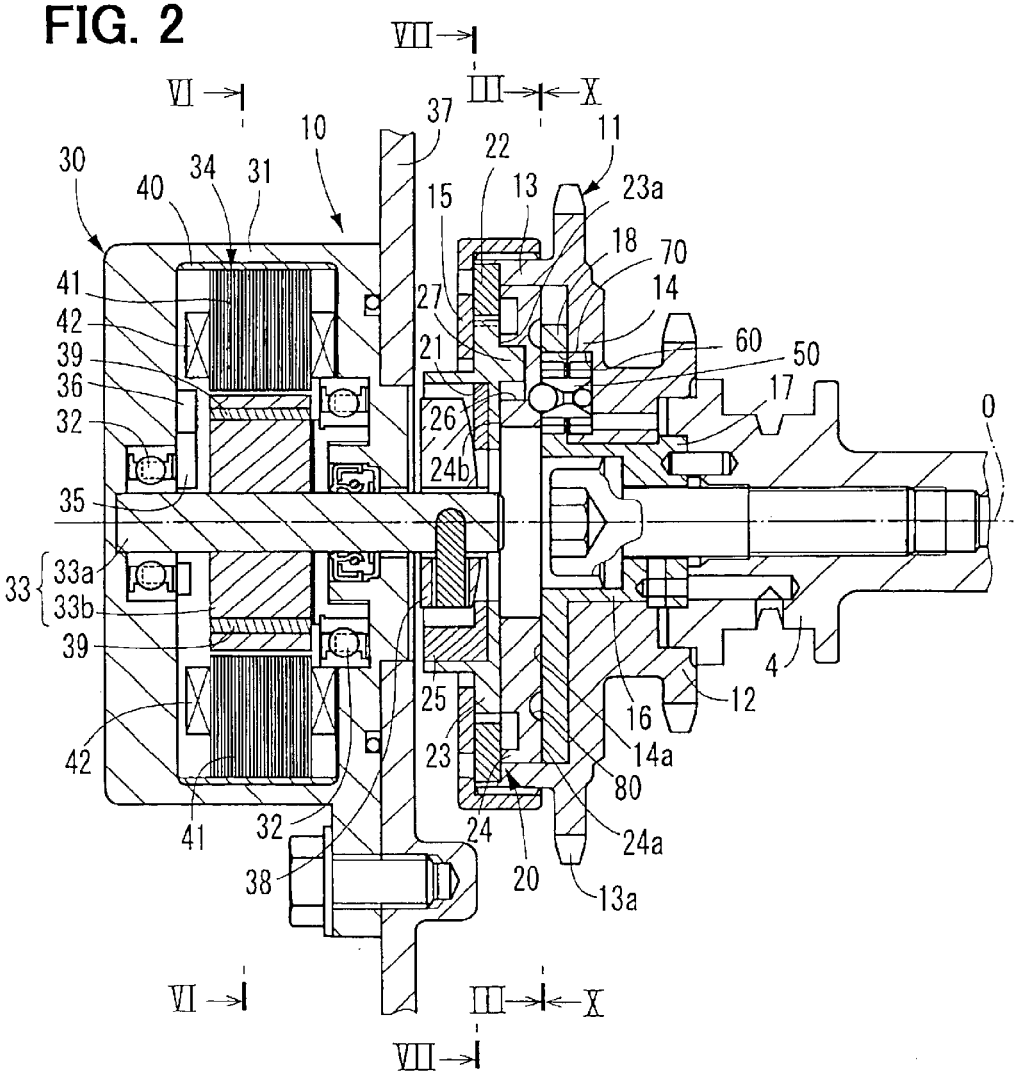
FIG. 2 is a cross sectional view of the VVT controller along a line II—II in FIG. 3 according to the first embodiment.

FIG. 2 shows a VVT controller according to the first embodiment of the present invention. The VVT controller 10 is disposed in a torque transfer system which transfers the torque of a crankshaft as a driving shaft of the engine to a cam shaft 4 as a driven shaft which opens and closes at least one of an intake valve or an exhaust valve. The VVT controller 10 adjusts the valve timing of intake valve by varying the rotational phase of the cam shaft 4 as shown by an arrow 200 in FIG. 1.

Figure 3:
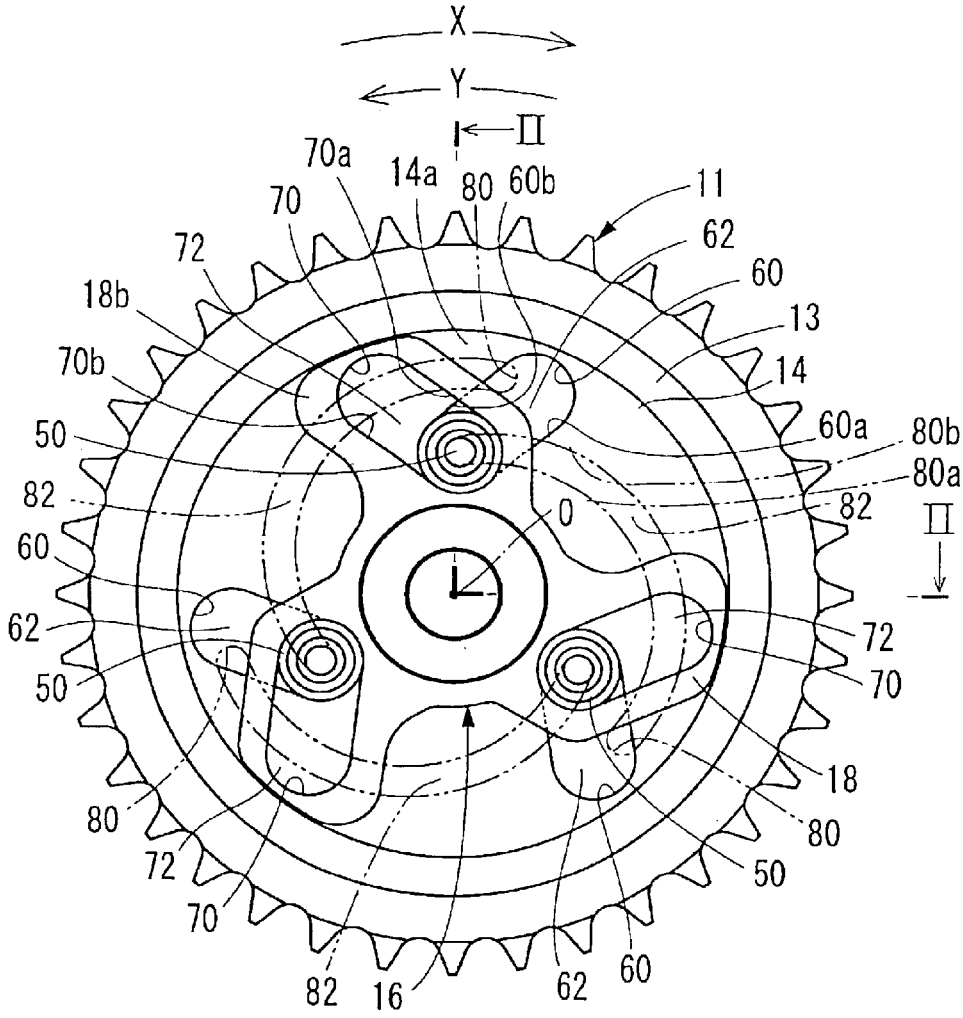
FIG. 3 is a cross sectional view of VVT controller along a line III—III in FIG. 2 for explaining an operation according to the first embodiment.

As shown in FIGS. 2 and 3, a sprocket 11 as a driving rotator is provided with a supporting portion 12, a input portion 13 having a larger diameter than that of the supporting portion 12, and a first converting portion 14 connecting the supporting portion 12 with the input portion 13. The supporting portion 12 is rotatively supported by the cam shaft 4 and output shaft 16 around a center axis O. A chain belt (not shown) runs over a plurality of gear tooth 13*a* formed on the input portion 13 and a plurality of gear tooth formed on the crank shaft (not shown). When the torque is transmitted from the crank shaft to the input portion 13 through a chain belt, the sprocket 11 rotates clockwise around the center axis O with keeping the rotational phase to the crankshaft. The sprocket 11 rotates in synchronism with the rotation of the crankshaft.

The output shaft 16 as the driven shaft has a fixed portion 17 and converting portion 18. One end of the cam shaft 4 is concentrically coupled to the fixed portion 17 by a bolt, and the output shaft 16 rotates around the center axis O with keeping the rotational phase to the cam shaft 4. That is, the output shaft 16 rotates in synchronism with the rotation of the cam shaft 4. A second converting portion 18, a planetary gear 23 and a transfer member 24 are sandwiched between a cover 15 and the first converting portion 14. The second converting portion 18 keeps contact with the inner surface 14*a* of the first converting portion 14 and confronts the outer surface 24*a* of the transfer member 24 with a clearance. A control member 50 is connected with the first converting portion 14 and the second converting portion 18. The output shaft 16 rotates clockwise in FIG. 3 via the control member 50 as well as the sprocket 11 rotates with the crankshaft. The output shaft 16 can rotate in advance direction X and delay direction Y in FIG. 3.

Figure 4:
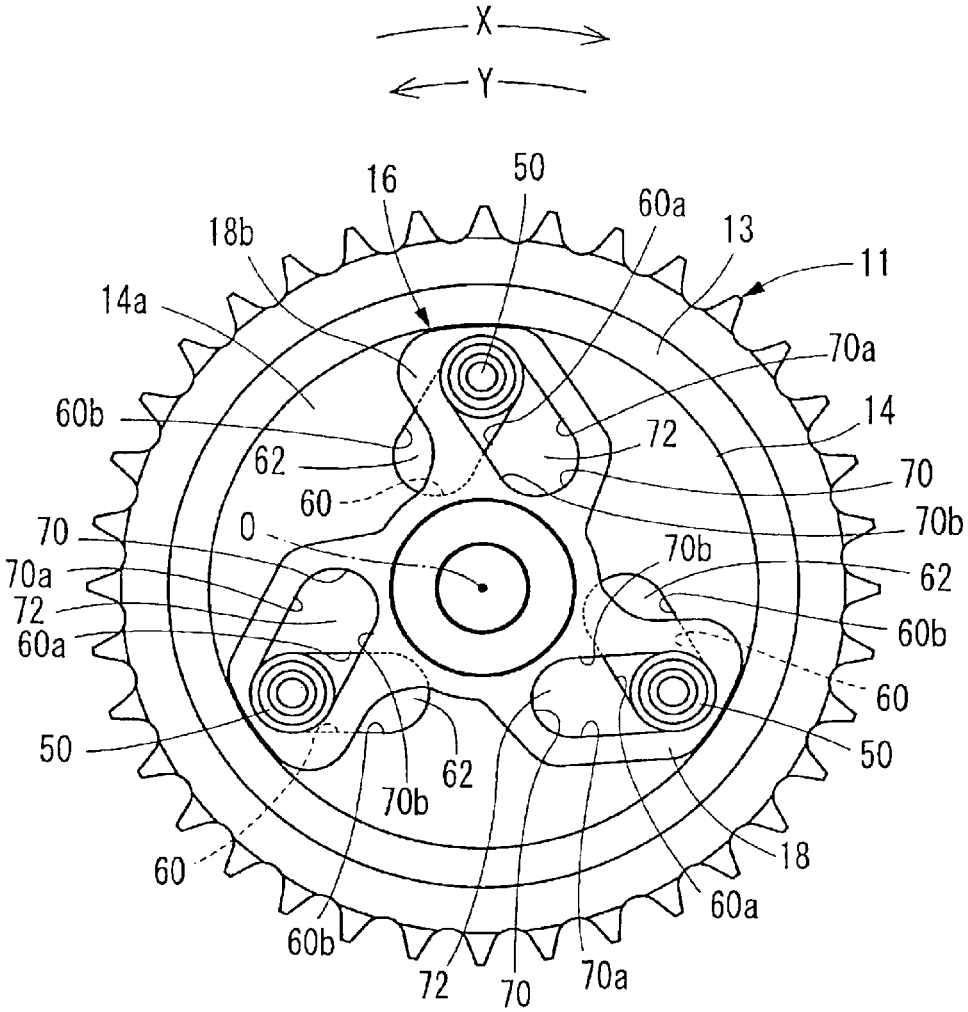
FIG. 4 is a cross sectional view of VVT controller along a line III—III in FIG. 2 for explaining the other operation according to the first embodiment.
Figure 5:
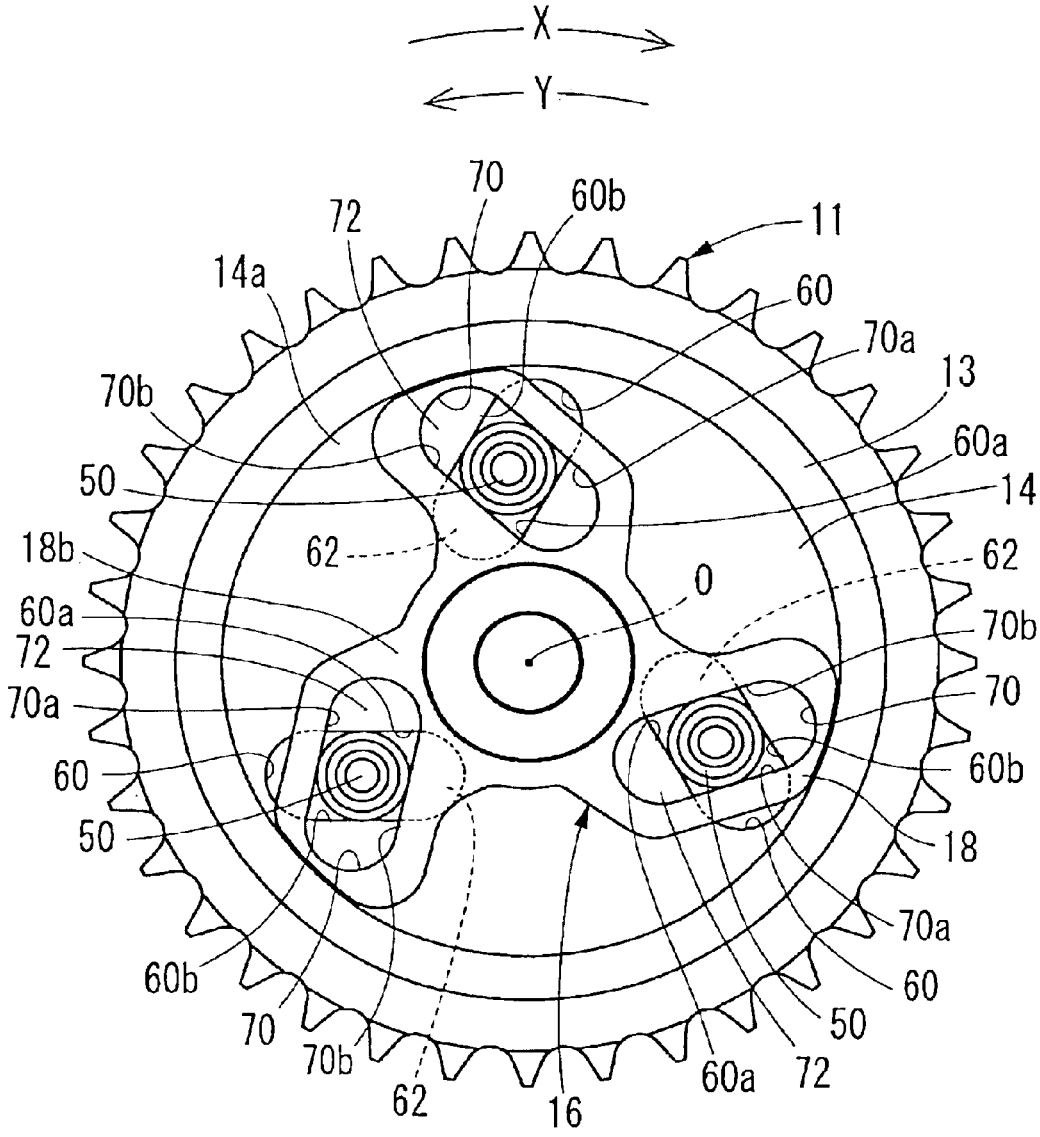
FIG. 5 is a cross sectional view of VVT controller along a line III—III in FIG. 2 for explaining the other operation according to the first embodiment.

FIG. 3 shows the cam shaft 4 is in the most delayed position, FIG. 4 shows the cam shaft 4 is in the most advanced position, and FIG. 5 shows the cam shaft 4 is in the middle position relative to the sprocket 11 and the crankshaft. The cam shaft 4 positioning the most delayed phase, the valve timing of the intake valve is the most delayed phase as shown by the dashed line in FIG. 1 so that the engine can be started. The most delayed phase in this embodiment corresponds to the feasible phase. On the other hand, the cam shaft 4 positioning the most advanced phase, the valve timing of the intake valve is the most advanced phase as shown by the solid line in FIG. 1 so that the engine can not be started.

Figure 6:
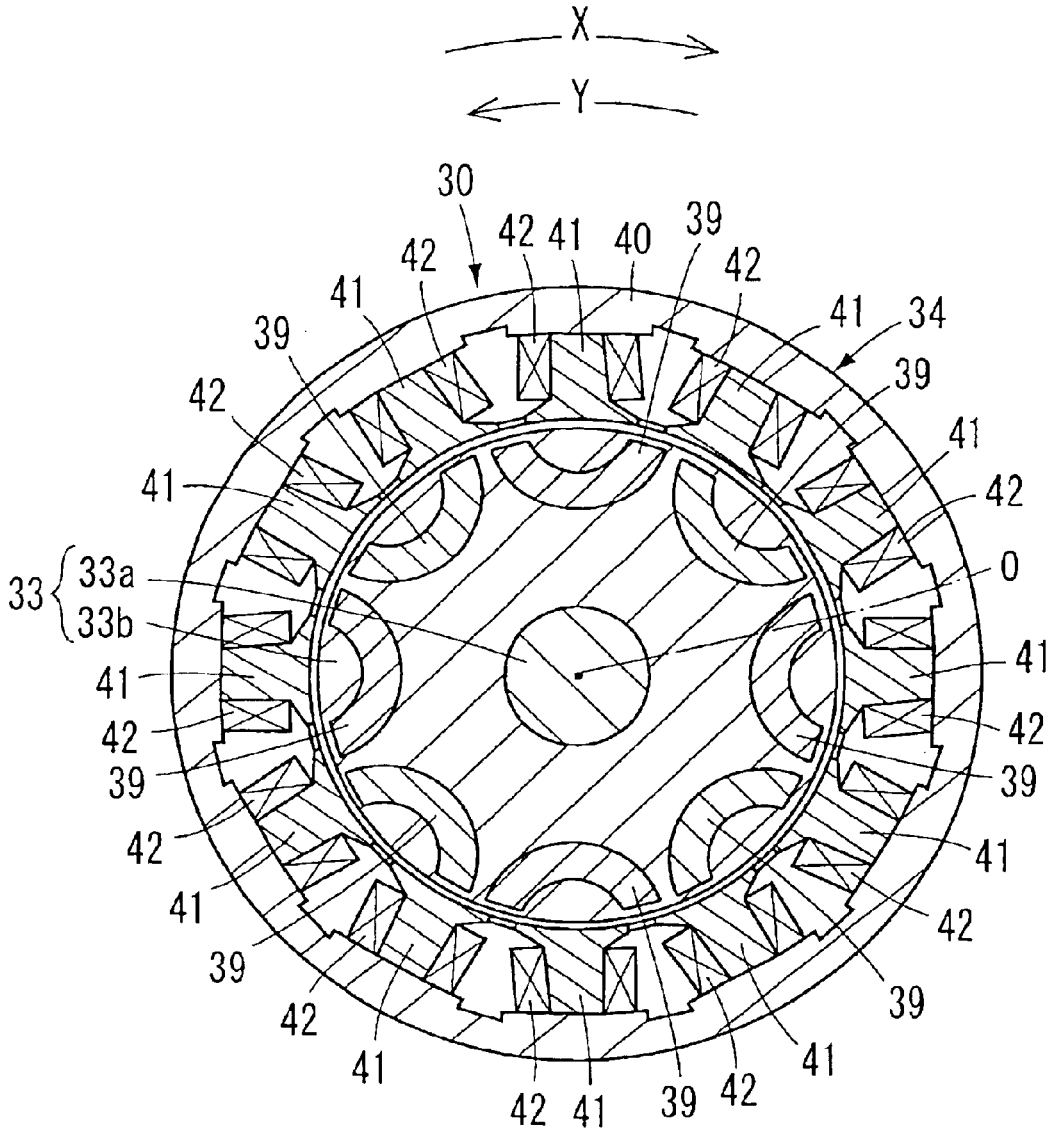
FIG. 6 is a cross sectional view of VVT controller along line VI—VI in FIG. 2.

An electric motor 30 is a three-phase motor and comprised of a housing 31, a bearing 32, a motor shaft 33, a stator 34, a driving circuit 35 and the control circuit 36. The housing 31 is fixed on the engine through a stay 37 as shown in FIG. 2 and FIG. 6. The housing 31 is provided with a pair of bearing 32.

A motor shaft 33 is supported by the pair of bearing 32 and rotates around the center axis O. The motor shaft 33 is connected with an eccentric shaft 25 through a joint 38 so that the motor shaft 33 rotates clockwise with the eccentric shaft 25 in FIG. 6 and FIG. 7. The motor shaft 33 has a shaft body 33*a* and a disk-shaped rotor 33*b*. A plurality of magnets 39 are disposed in the rotor 33*b* near the outer periphery. The magnets 39 are made from rare-earth magnets and are disposed with same pitch around the center axis O. Adjacent magnets are disposed respectively in such a manner that a magnetic pole of the outer surface is reverse to each other.

Figure 8:
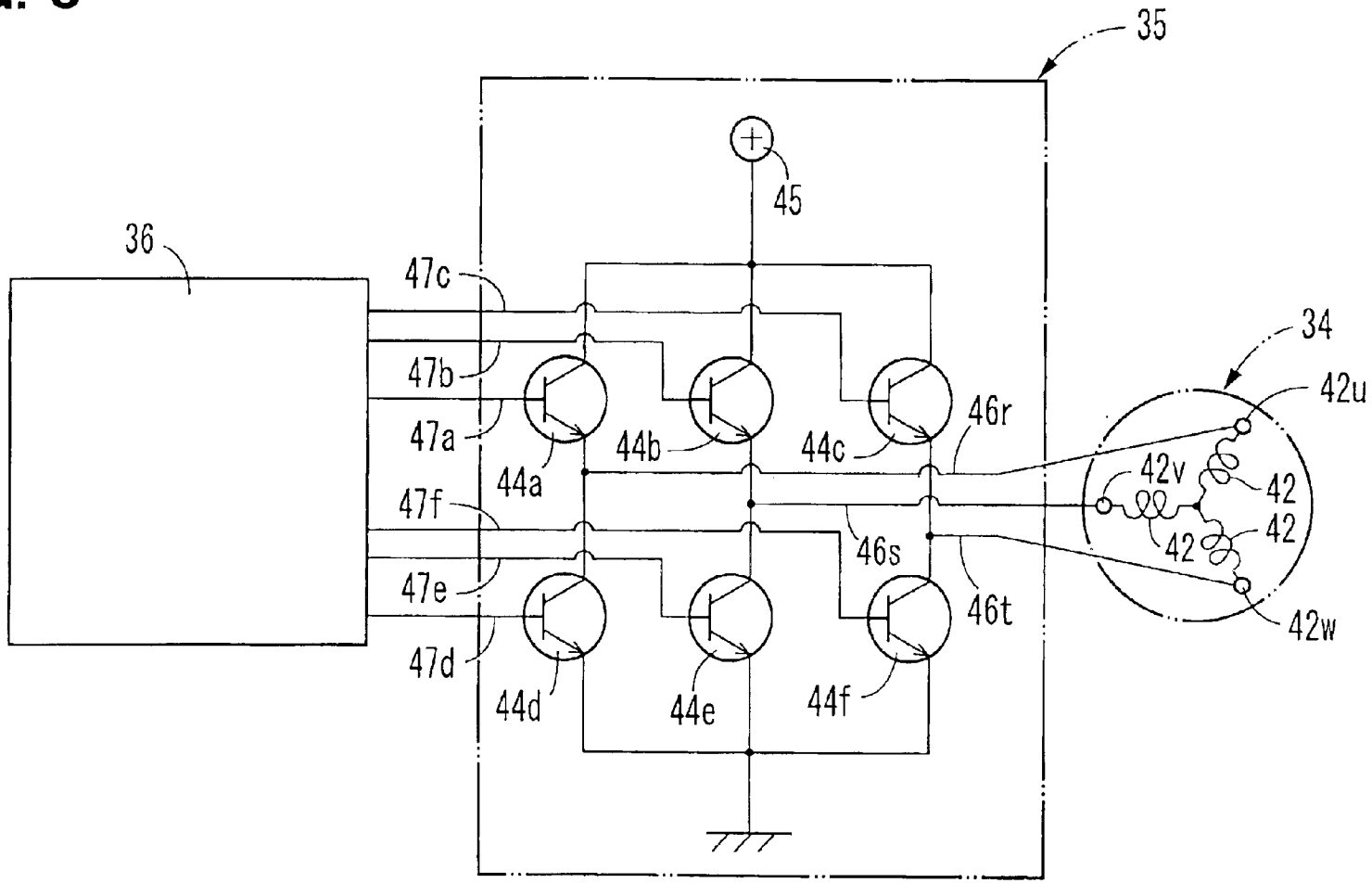
FIG. 8 is a circuit diagram showing a stator, a driving circuit and a control circuit of the VVT controller according to the first embodiment.

The stator 34 is fixed on the engine through the housing 31 and the stay 37 at the outer side of the motor shaft 33. The stator 34 has a cylindrical body 40, a core 41 and a coil 42. The core 41 are formed by stacking a plurality of iron plates and protrudes toward the motor shaft 33 from the inner surface of the body 40. The core 41 has twelve protrusions in same pitch, the coil 42 is wound on each protrusions. As shown in FIG. 8 schematically, the coil 42 is connected in Y-connection and has three terminals 42*u*,42*v*,42*w*.

A driving circuit 35 is a bride circuit as shown in FIG. 8 and has six transistors as switching elements. The collector of the transistors are connected with an electric main power 45, and the emitter of the transistors are grounded. The emitter of the transistor 44*a* and the collector of the transistor 44*d* are connected with the terminal 42*u* via a lead 46*r*, the emitter of the transistor 44*b* and the collector of the transistor 44*e* is connected with the terminal 42*v* through a lead 46*s*, and the emitter of the transistor 44*c* and the collector of the transistor 44*f* is connected with the terminal 42*w*. The base of the transistor 47*a*,47*b*,47*c*,47*d*,47*e*,47*f* are connected with a control circuit 36.

The control circuit 36 has a microcomputer and detects the condition of the VVT controller 10 base on the signals such as the current value of the driving circuit 35 and the rotation angle of the motor shaft 33.

If there is no problem in the VVT controller, the control circuit 36 varies the current value which is fed to the base of the transistor 44*a*–44*f*. The transistor 44*a*–44*f* is turned on or turned off in a sequence according to the variation of the current fed to the bases thereof. The sequence of on-off of transistor 44*a*–44*f* is controlled by the control circuit 36 in an order or in inverse order. When the current is fed to the coil 42 via the terminal 42*u*,42*v*,42*w* in this order, the magnetic field is formed clockwise around the motor shaft 33. In this magnetic field, since the magnets 39 receive the attract force and repel force, the torque in advance direction X is applied to the motor shaft 39. When the current is fed to the coil 42 via the terminal 42*u*,42*v*,42*w* in inverse order, the magnetic field is formed anti-clockwise around the motor shaft 33. In this magnetic field, since the magnets 39 receive the attract force and repel force, the torque in delay direction Y is applied to the motor shaft 39.

The driving motor shaft 33 receives a friction torque in delay direction Y due to the friction between the motor shaft 33 and the bearings 32. The driving motor shaft 33 generates a counter electromotive force by the interaction between the magnets 39 and the coil 42 and receives the breaking torque in delay direction Y corresponding to the counter electromotive force by the interaction. In case of keeping the torque constant, the control circuit 36 controls the current fed to the coil 42 so that the torque in advance direction X is applied to the motor shaft 33, the torque canceling the friction torque and the breaking torque. In case of increasing the torque in advance direction or in delay direction, the control circuit 36 controls the current fed to the coil 42 with reflecting the friction torque and the breaking torque.

If at least one of the lead 46*r*–46*t* causes an electrical shorting or a break, the control circuit 36 turn of the transistors 44*a*,44*b*,44*c* and turn on the transistors 44*d*,44*e*, 44*f* by controlling the input current fed to the transistors 44*a*–44*f*. Thereby, the driving circuit 35 forms a short-loop with causing an electrical shorting among the terminals 42*u*,42*v*,42*w*.

A reduction gearing 20 is comprised of a ring gear 22, the eccentric shaft 25, the planetary gear 23 and the transfer member 24. The ring gear 22 is fixed on the inner surface of the input portion 13. The ring gear 22 is an internal gear of which an addendum circle is inside of a dedendum circle. The ring gear 22 rotates clockwise around the center axis O in FIG. 7 with the sprocket 11.

Figure 7:
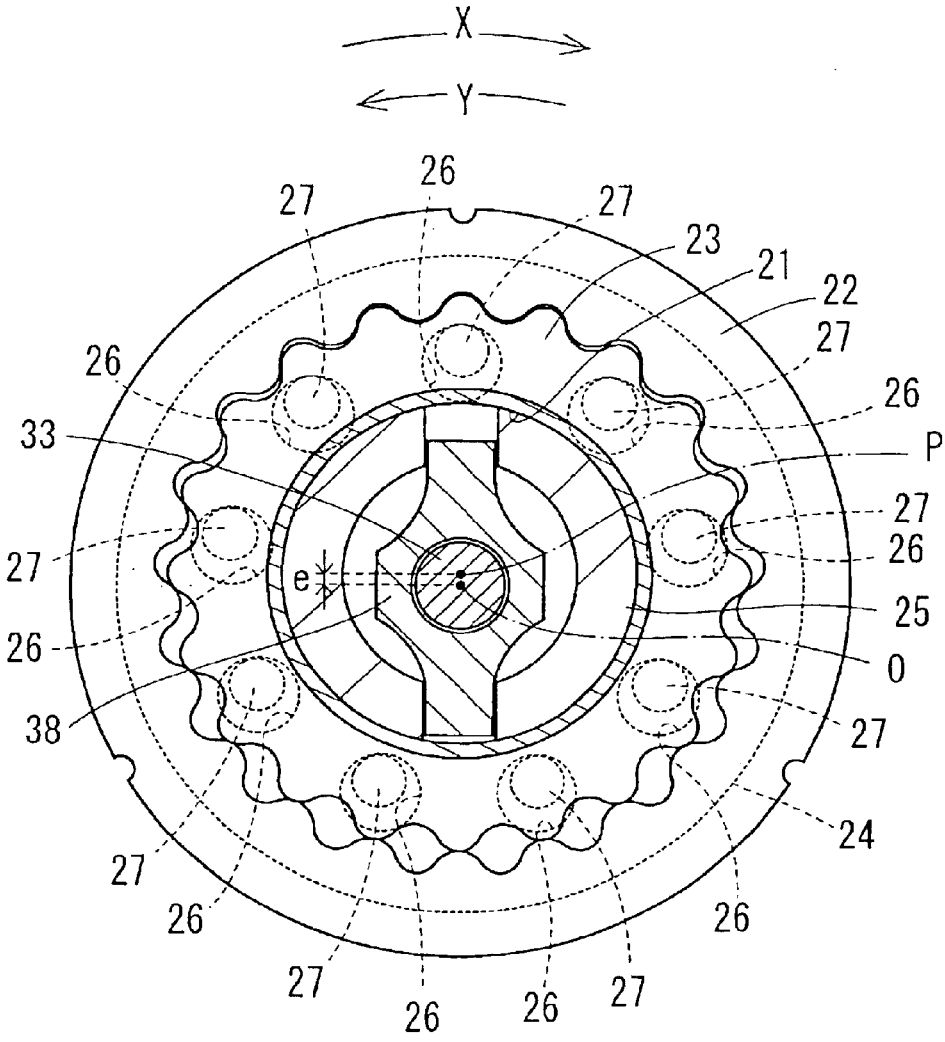
FIG. 7 is a cross sectional view of VVT controller along line VII—VII in FIG. 2.

The eccentric shaft 25 is connected with the motor shaft 33 of the electric motor 30 so that the eccentric shaft 25 is offset against the center shaft O. In FIG. 7, "P" represents an axis of the eccentric shaft 25 and "e" represents an eccentric amount of the eccentric shaft 25 relative to the center shaft O.

The planetary gear 23 is comprised of an external gear of which an addendum circle is outside of a dedendum circle. A curvature of the addendum circle of the planetary gear 23 is smaller than that of the dedendum circlet of the ring gear 22. The planetary gear 23 has one more tooth than the ring gear 22. The planetary gear 23 is located inside of the ring gear 23 with engaging a part of teeth of the planetary gear 23 with a part of teeth of the ring gear 22. The planetary gear 23 has an circular engage hole 23 on the same axis. One end of the eccentric shaft 25 is inserted into the circular engage hole 23 through a bearing (not shown). The planetary gear 23 is supported by an outer surface of the eccentric shaft 25 so that the planetary gear 23 can rotate relatively to the eccentric axis P. Thereby, the eccentric shaft 25 can rotate in advance direction X or in delay direction Y relative to the sprocket 11.

The transfer member 24 as an transfer rotor is formed like a circular plate and is supported by the inner surface of the input portion 13 so that the transfer member 24 rotates around the center axis O relatively. The transfer member 24 has nine engage holes 26 which are arranged in same pitch around the center axis O. The engage holes have a circular shape and confront the outer surface 24*b* of the transfer member 24 which keeps in touch with the planetary gear 23. Engage projections 27 are formed in nine places which face each engage holes 26 at outer surface 23*a* of the planetary gear 23 which touches the transfer member 24. Each engage projection 27 is formed in the circumference of the eccentric axis P of the eccentric shaft 25 at equal intervals. Each engage projection 27 is cylindrical shape and engages with the engage holes 26. The diameter of the engage projection 27 is smaller than the inner diameter of the engage holes 26. The control member 50 is connected with the outer surface 24*a* of the transfer member 24 in a second converting portion side.

While the friction torque and the breaking torque are constant, and when the torque applied to the motor shaft 33 and transmitted to the eccentric shaft 25 is constant, the planetary gear 23 does not rotate relative to the eccentric shaft 25. Thereby, the planetary gear 23 engages the ring gear 22 and rotates with the sprocket 11, the eccentric shaft 25 and the motor shaft 33 with keeping the rotational phase constant relative to the ring gear 22. The engage projection 27 presses the inner surface of the engage hole 26 in a rotational direction (advance direction X in this case), and the transfer member 24 rotates clockwise around the center axis O in FIG. 7 with keeping the rotational phase constant relative to the sprocket 11. The period when the friction torque and the breaking torque do not change substantially is referred to as invariable period.

During the invariable period, when the torque applied to the motor shaft 33 increases in the delay direction Y, the planetary gear 23 rotates relatively in the advance direction X to the eccentric shaft 25 with being pressed by the outer surface of the eccentric shaft 25 and with receiving the function of the ring gear 22. The planetary gear 23 rotates in the advance direction relative to the sprocket 11 with engaging with the ring gear 23 partially. Since the forth in which the engage projection 27 presses the engage hole 26 in the advance direction increases, the transfer member 24 rotates relatively in the advance direction X to the sprocket 11. As described above, the reduction gearing 20 transmits the amount of torque changed to the transfer member 24 while changing the direction into the advance direction X and increasing the amount of the torque applied to the motor shaft 33.

During the invariable period, when the torque applied to the motor shaft 33 increases in the advance direction X, the planetary gear 23 rotates relatively in the delay direction Y to the eccentric shaft 25 with being pressed by the outer surface of the eccentric shaft 25 and with receiving the function of the ring gear 22. The planetary gear 23 rotates relatively in the delay direction Y to the sprocket 11 with engaging with the ring gear 23 partially. Since the forth in which the engage projection 27 presses the engage hole 26 in the advance direction increases, the transfer member 24 rotates relatively in the advance direction X to the sprocket 11. As described above, the reduction gearing 20 transmits the amount of torque changed to the transfer member 24 while changing the direction into the delay direction Y and increasing the amount of the torque applied to the motor shaft 33.

A conventional reduction gearing can be used instead of the reduction gearing 20 of the present embodiment. The torque applied to the motor shaft 33 can be transmitted to the transfer member 24 directly.

A phase converter is comprised of the transfer member 24, the first converting portion 14 and the second converting portion 18, which are connected with each other. The phase converter varies the rotational phase of the cam shaft 4 relatively to the crankshaft by converting the relative rotational movement of the transfer member 24 against the sprocket 11 into the relative rotational movement into the relative rotational movement of the output shaft 19 against the sprocket 11. Referring to FIGS. 2–5, FIG. 9 and FIG. 10, the structure of the phase converter is described herein after. In FIG. 3–5, a hatching is omitted.

Figure 9:
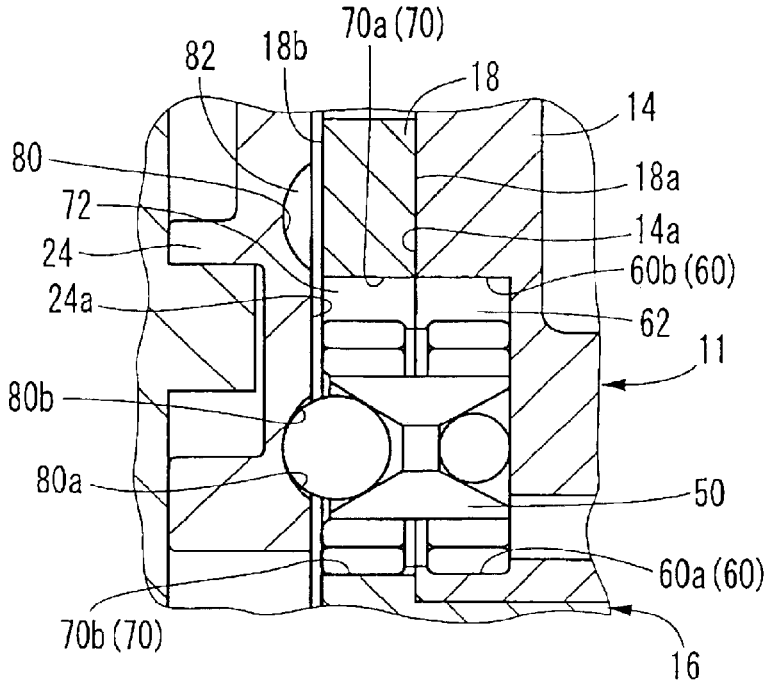
FIG. 9 is an enlarged view of essential part of FIG. 2.

As shown in FIG. 3, the first converting portion 14 is a circular plate which is vertical to the center axis O and has three holes 60. Each of the holes 60 is formed in 120 degrees interval. As shown in FIG. 3 and FIG. 9, the holes 60 are opened at the inner surface 14*a* of the first converter 14 which is contacting with the second converter 18. Inner surfaces of the holes 60 form the trajectories 62 through which the control member 50 passes. The trajectories 62 inclined against the first converter 14 such that the radial distance from the center axis O varies. In this embodiment, the trajectories 62 are straight lines inclined into the delay direction Y with departing from the center axis O.

As shown in FIG. 3, the second converting portion 18 is a plate shaped like triangle which is vertical to the center axis O, and have three holes 70 confronting to the holes 60 of the first converting portion 14. Each of holes 70 is formed near the three apexes of the second converting portion 18 in 120 degrees interval. As shown in FIG. 3 and FIG. 9, the holes 70 penetrate the second converting portion 18 in the thickness thereof and confront the outer surface 18*a* and outer surface 18*b*. The holes 70 form trajectories 62 by the inner surface thereof, through which the control member 50 passes by the inner surface thereof. The trajectories 72 are inclined against the radial axis of the second converting portion 18 with varying the distance from the center axis O. In this embodiment, the trajectories 72 are straight lines inclined into the delay direction Y with departing from the center axis O. Thereby, the trajectories 72 of the holes 70 and the trajectories 62 of the holes 60 cross each other at the place corresponding to the rotational phase of the output shaft 19 relative to the sprocket 11.

As shown in FIG. 3, the control member 50 is disposed at the three places corresponding to three of the holes 60,70. As shown in FIG. 2, FIG. 3 and FIG. 9, the control members 50 are cylindrical shape, and sandwiched between the first converting portion 14and the transfer member 24 passing through cross points of the trajectories 62 and the trajectories 72. The control members 50 contact the inner side surfaces 60*a* and 60*b* of the holes 60 and also contact the side inner surfaces 70*a* and 70*b* of the holes 70.

Figure 10:
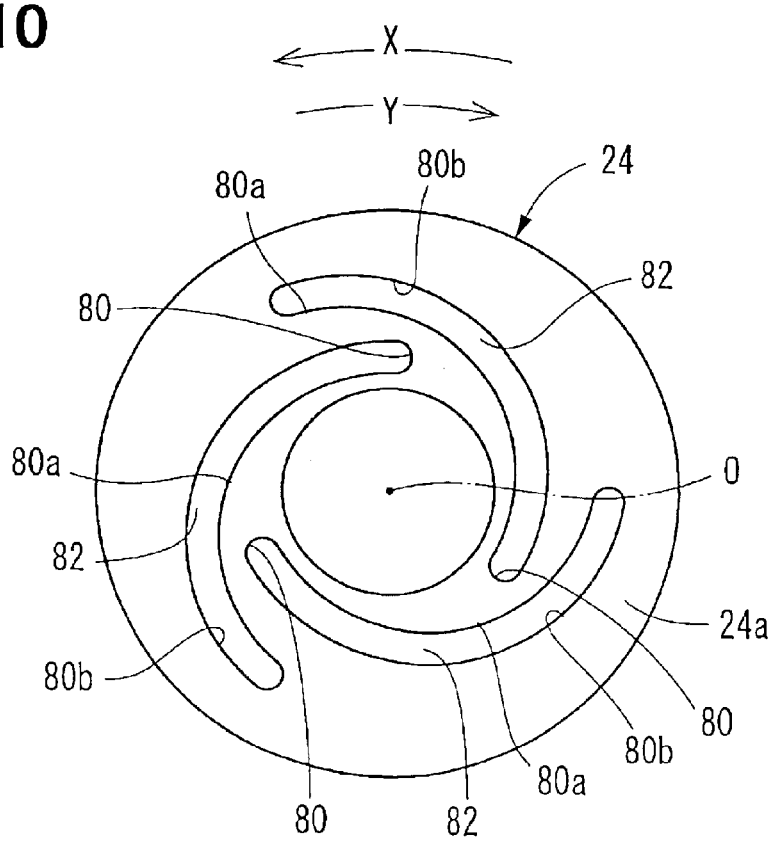
FIG. 10 is a side view of a transmitting member of the VVT controller along a line X—X of FIG. 2.

As shown in FIG. 10, the transfer member 24 has three holes 80 which are formed in 120 degree interval around the center axis O. As shown in FIG. 9 and FIG. 10, the holes 80 are opened at the outer surface 24*a* of the transfer member 24 confronting the second converting portion 18. The inner surface of the holes 80 form trajectories 80 respectively through which the control member 50 passes. The trajectories 82 is inclined against the radial axis of the transfer member 24 such that the radial distance from the center axis O varies. In this embodiment, the trajectories 82 is eccentric to the center axis O and is arc shaped which are inclined in the advance direction X as departing from the center axis O and cross the trajectories 62, 72. In each of the trajectory 82, the control member 50 is inserted. The control member 50 is contact with the inner side surfaces 80*a* and 80*b*.

When the transfer member 24 keeps the rotational phase constant, the control member 50 stays in the trajectory 82 and rotates with the transfer member 24. The control member 50 stays also in the trajectories 62,72, and transmits the input torque from the sprocket 11 to the output shaft 16.

When the transfer member 24 rotates relatively in the advance direction X to the sprocket 11, the control member 50 is pressed by the side surface 80*b* extending radial outside of the trajectory 82. The control member 50 moves in the delay direction Y toward the center of the transfer member 24 and makes the radial distance from the center axis O (referred to as the radial distance herein after) short. At the same time, the control member 50 presses the side surface 60*a* of the trajectory 62 in the advance direction X and presses the side surface 70*b* in the delay direction Y. Thereby, the control member 50 passing in the trajectory 62,72, the output shaft 16 rotates relatively in the delay direction Y to the sprocket 11.

When the transfer member 24 rotates relatively in the delay direction Y, the control member 50 is pressed by the side surface 80*a* extending radial inside of the trajectory 82. The control member 50 moves in the advance direction X toward the peripheral of the transfer member 24 and makes the radial distance long. At the same time, the control member 50 presses the side surface 60*b* of the trajectory 62 in the delay direction Y and presses the side surface 70*a* in the advance direction X. Thereby, the control member 50 passing in the trajectory 62,72, the output shaft 16 rotates relatively in the advance direction X to the sprocket 11.

The operation of the VVT controller is described herein after.

(First Operation)

When the rotational phase of the cam shaft 4 relative to the crankshaft is unchanged during the invariable period, the control circuit 36 controls the current fed to the stator 34 from the driving circuit 35 so that the applied torque to the motor shaft 33 is kept constant. Since the relative rotation of the transfer member 24 to the sprocket 11 does not occur, the relative rotation of the output shaft 16 to the sprocket 11 does not occur. Therefore, the rotational phase of the cam shaft 4 against the crankshaft is kept constant.

(Second Operation)

When the rotational phase of the cam shaft 4 relative to the crankshaft is delayed during the invariable period, the control circuit 36 controls the current fed to the stator 34 from the driving circuit 35 so that the applied torque to the motor shaft 33 is increased in the delay direction. The increased torque is altered the direction thereof by the reduction gearing 20 and transmitted to the transfer member 24, thus the transfer member 24 rotates relatively in the advance direction X to the sprocket 11. The radial distance of the control member 50 becomes short, and the output shaft 16 rotates relatively in the delay direction Y to the sprocket 11. The rotational phase of the cam shaft 4 against the crankshaft is altered toward the delay direction.

(Third Operation)

When the rotational phase of the cam shaft 4 relative to the crankshaft is advanced during the invariable period, the control circuit 36 controls the current fed to the stator 34 from the driving circuit 35 so that the applied torque to the motor shaft 33 is increased in the advance direction. The increased torque is altered the direction thereof by the reduction gearing 20 and transmitted to the transfer member 24, thus the transfer member 24 rotates relatively in the delay direction Y to the sprocket 11. The radial distance of the control member 50 becomes long, and the output shaft 16 rotates relatively in the advance direction X to the sprocket 11. The rotational phase of the cam shaft 4 against the crankshaft is altered toward the advance direction.

(Fourth Operation)

When a electrical break or shorting arises in one of the leads 46*r*–46*t* in the first operation through the third operation, the current supply to the corresponding coil 42 is stopped. The control circuit 36 controls the driving circuit 35 such that electrical shorts arise among the terminal 42*u*,42*v*, 42*w*, the current supply to the remaining coils 42 is stopped. The rotating magnetic field around each of the coils 42 is ceased, the electrical resistance among the terminal 42*u*,42*v*, 42*w* decrease rapidly, and the counter-electromotive force generated by the coils 42 increases. The breaking torque arose by the counter-electromotive force and the friction torque between the motor shaft 33 and the bearing 32 are applied to the motor shaft 33 as a load torque. The load torque is altered the direction thereof and transmitted to the transfer member 24. Thus the transfer member 24 and the output shaft 16 rotate relatively in the advance direction X and the delay direction Y to the sprocket 11, the rotational phase of the cam shaft 4 against the crankshaft is changed to the delay direction. In this embodiment, that is, the rotational phase of the cam shaft varies from the most advanced position in which the engine can not be started to the most delayed position in which the engine can be started in the more safety direction. Thereby the changes of the rotational phase into the most advanced position in which the engine can not be started is prevented.

(Second Embodiment)

Figure 11:
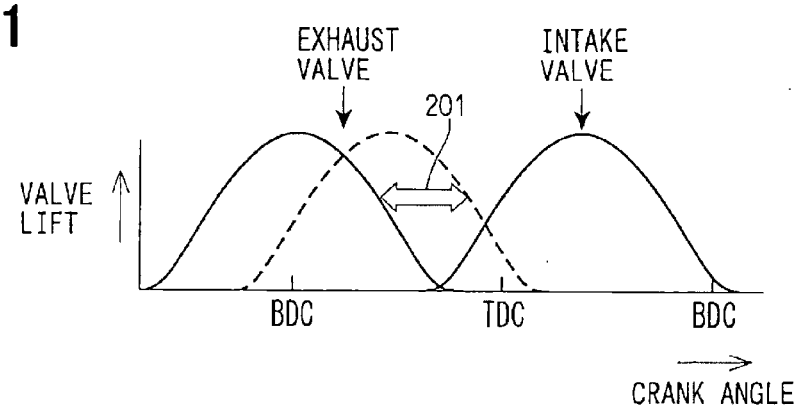
FIG. 11 is a characteristic diagram for explaining the function of the VVT controller according to the second embodiment.

The VVT controller of the second embodiment adjusts the valve timing of intake valve by varying the rotational phase of the cam shaft 4 as shown by an arrow 201 in FIG. 11.

Figure 12:
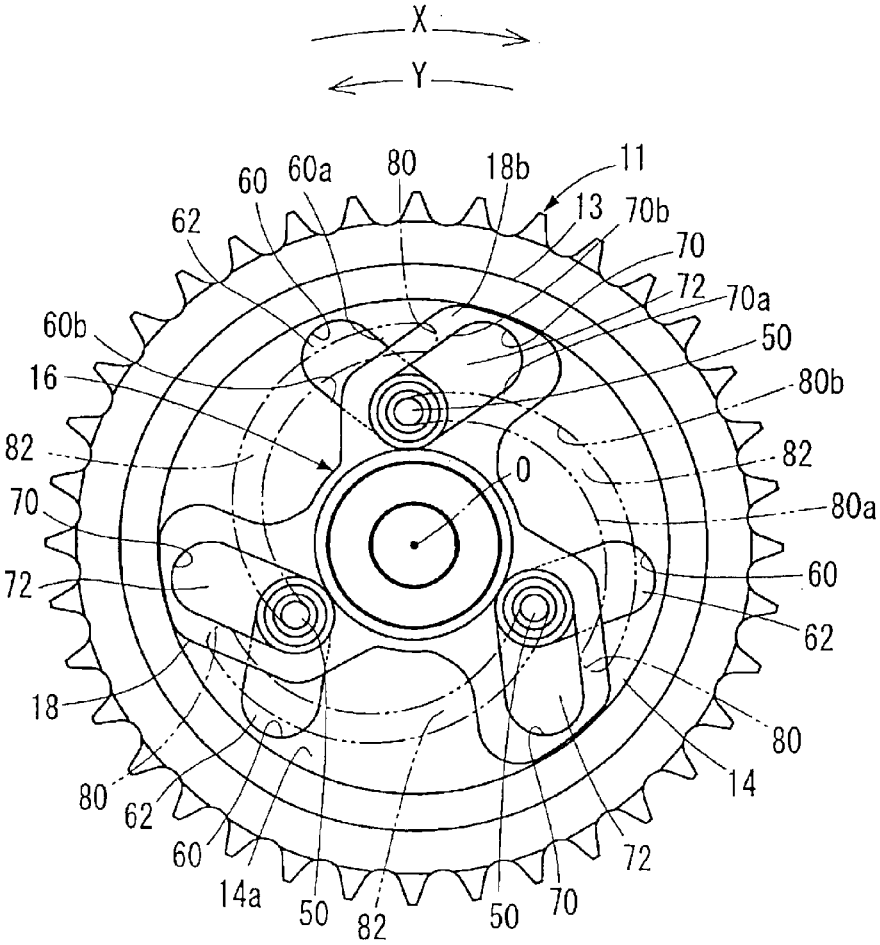
FIG. 12 is a cross sectional view of the VVT controller along a line III—III in FIG. 2 according to the second embodiment.
Figure 13:
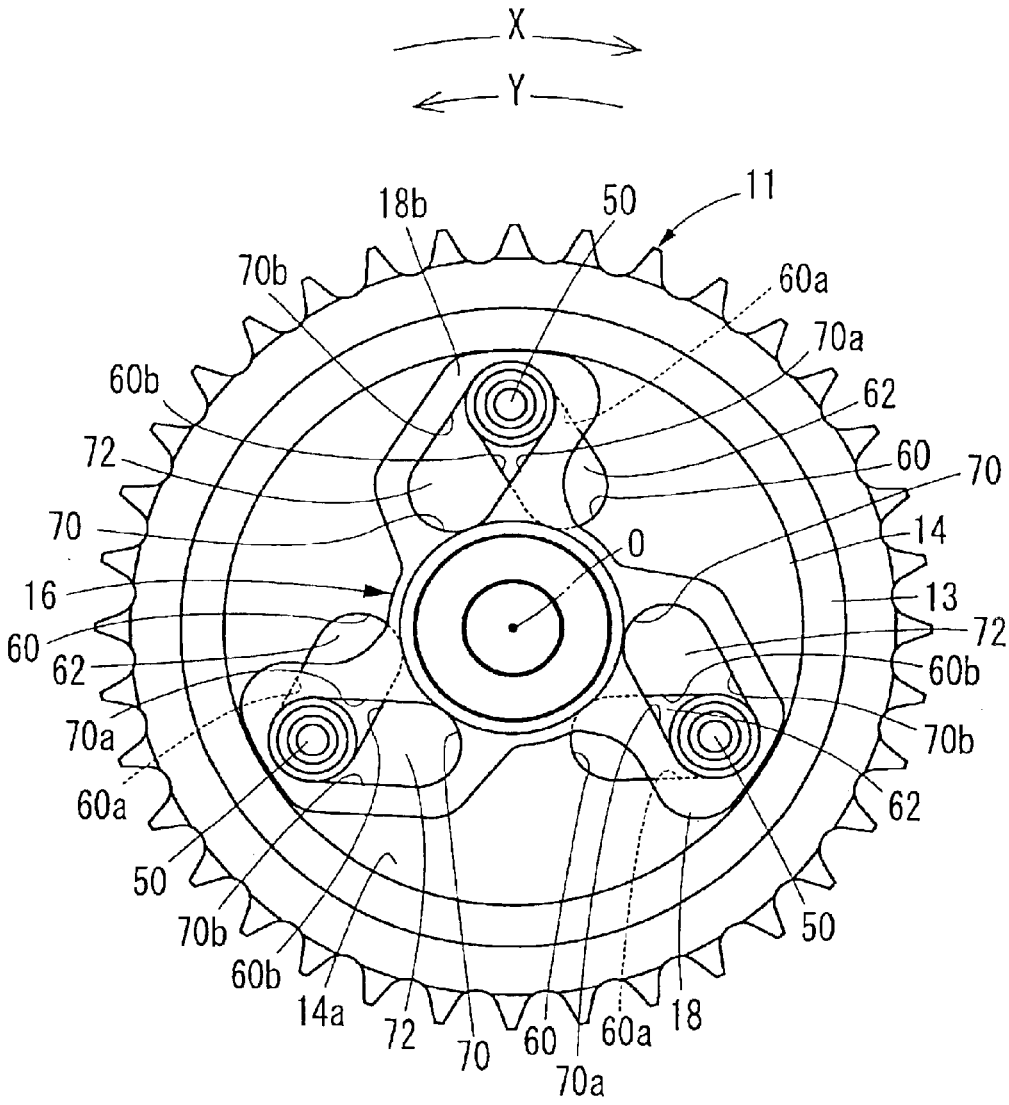
FIG. 13 is a cross sectional view of VVT controller along a line III—III in FIG. 2 for explaining an operation according to the second embodiment.

FIG. 12 shows the cam shaft 4 is in the most advanced position, FIG. 13 shows the cam shaft 4 is in the most delayed position relative to the sprocket 11 and the crankshaft. The cam shaft 4 positioning the most advanced phase, the valve timing of the intake valve is the most advances phase as shown by the solid line in FIG. 11 so that the engine can be started. The most advanced phase in this embodiment corresponds to the feasible phase. On the other hand, the cam shaft 4 positioning the most delayed phase as shown by the dashed line in FIG. 11, the valve timing of the intake valve is the most delayed phase so that the engine can not be started.

As shown in FIG. 12 and FIG. 13, the trajectory 62 of each hole 60 is a straight line inclined to the delayed direction Y according as the trajectory 62 is depart from the center axis O. The trajectory 72 of each hole 70 is a straight line inclined to the advanced direction X according to the trajectory 72 is depart from the center axis O. The trajectory 72, the trajectory 62 and the trajectory 82 cross one another at the position corresponding to the rotational phase of the output shaft 16 against the sprocket 11.

The operation of the second embodiment is described herein after.

(First Operation)

When the rotational phase of the cam shaft 4 relative to the crankshaft is unchanged during the invariable period, the control circuit 36 controls the current fed to the stator 34 from the driving circuit 35 so that the applied torque to the motor shaft 33 is kept constant. Since the relative rotation of the transfer member 24 to the sprocket 11 does not occur, the relative rotation of the output shaft 16 to the sprocket 11 does not occur. Therefore, the rotational phase of the cam shaft 4 against the crankshaft is kept constant.

(Second Operation)

When the rotational phase of the cam shaft 4 relative to the crankshaft is delayed during the invariable period, the applied torque to the motor shaft 33 is increased in the advance direction X as well as the third operation of the first embodiment, and the transfer member 24 is relatively rotated in the delay direction Y. The control member 50 is pressed by the side surface 80*a* of the trajectory 62 and moves in the trajectory 82 in the advance direction with making the radial distance long. The control member 50 presses the side surface 60*a* of the trajectory 62 in the advance direction and presses the side surface 70*b* of the trajectory 72 in the delay direction. The control member 50 moving in the trajectories 62,72, the output shaft 16 rotates relatively in the delay direction to the sprocket 11. The cam shaft 4 rotates relatively in the delay direction to the crank shaft.

(Third Operation)

When the rotational phase of the cam shaft 4 relative to the crankshaft is advanced during the invariable period, the applied torque to the motor shaft 33 is increased in the delay direction as well as the first operation of the first embodiment and the transfer member 50 is rotated relatively in the advance direction X to the sprocket 24. Thereby the control member 50 is pressed by the side surface 80*b* of the trajectory 82, and moves in the delay direction Y in the trajectory 62 with making the radius distance short. The control member 50 presses the side surface 60*b* of the trajectory 62 in the delay direction Y and presses the side surface 70*a* in the advance direction X. Thus the output shaft 16 rotates relatively to the sprocket 11 with moving in the trajectory 62,73. The output shaft 16 rotates relatively in the advance direction X, and the rotational phase of the cam shaft against the crankshaft changes into the advance direction X.

(Fourth Operation)

When the electrical shorts or break arise in on of the leads 46*r*–46*t* in from the first operation through the third operation, the load torque is applied to the motor shaft 33 as well as the fourth operation of the first embodiment and then transmitted to the transfer member 24 with altering the direction thereof. The transfer member 24 and the output shaft 16 rotate in the advance direction X as well as the third operation of this embodiment. Therefore the rotational phase of the cam shaft 4 is changed to the advance direction. In this embodiment described above, the rotational phase of the cam shaft 4 is varied in the safety direction in which the rotational phase is varied from the most delayed phase in which the engine can not be started to the most advanced phase in which the engine can be started.

(Third Embodiment)

The third embodiment of the present invention is described hereinafter.

The VVT controller of the third embodiment controls valve timing of the intake valve of the engine as well as the first embodiment.

Figure 14:
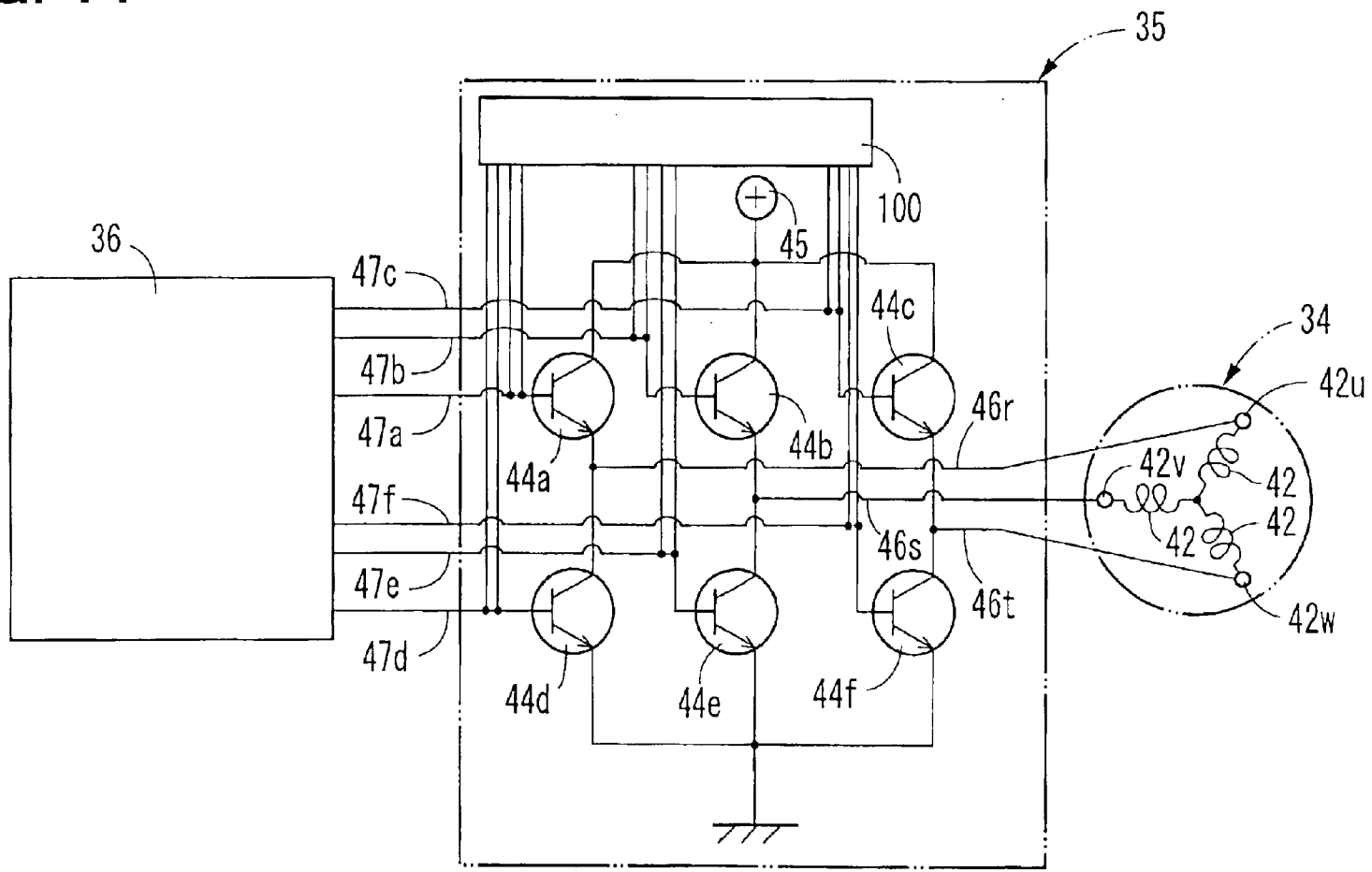
FIG. 14 is a circuit diagram showing a stator, a driving circuit and a control circuit of the VVT controller according to the third embodiment.

As shown in the FIG. 14, the driving circuit 35 has an auxiliary control circuit 100. The auxiliary circuit 100 has a microcomputer and an ammeter and is connected with leads 47*a*–47*f* which connect the base of the transistor 44*a*–44*f* with the control circuit 36.

When the current is not fed from the control circuit 36 to the transistor 44*a*–44*f* due to the electric short or break in the lead 47*a*–47*f*, the auxiliary circuit 100 controls the current fed to the each coil 42 instead of the control circuit 36. when the auxiliary circuit 100 detects that no current is fed to at least one of the lead 47*a*–47*f* for a predetermined period with the ammeter, the auxiliary circuit 100 feeds the current to the transistor 44*a*–44*f* to alter the current value. The driving circuit 35 turns off or turns on the transistor 44*a*–44*f* in reverse series to apply the control torque to the motor shaft 33 in the delay direction Y. As well as the fourth operation of the first embodiment, the load torque is transmitted to the motor shaft 33 and the transfer member 24 and the output shaft 16 relatively rotate in the advance direction or in the delay direction respectively. The rotational phase of the cam shaft 4 against the crankshaft changes into the delay direction. The rotational phase of the cam shaft 4 varies from the most advanced phase to the most delayed phase. Therefore, the engine can be started even after the current as a control signal is not fed from the control circuit 36 to the driving circuit 35.

(Fourth Embodiment)

The fourth embodiment of the present invention is described hereinafter.

The VVT controller of the fourth embodiment controls valve timing of the intake valve of the engine as well as the first embodiment.

Figure 15:
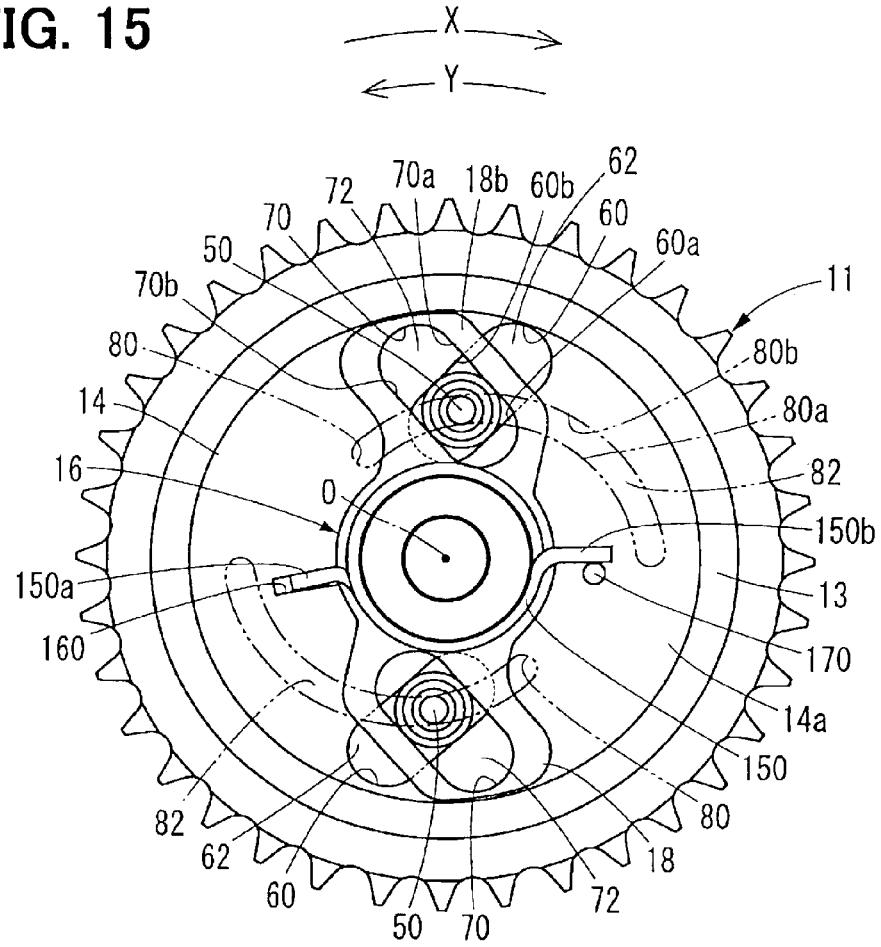
FIG. 15 is a cross sectional view of the VVT controller along a line III—III in FIG. 2 for explaining an operation according to the fourth embodiment.

As shown in FIG. 15, the second converting portion 18 is a Z-shaped plate which is vertical to the center axis O and has two holes 70 at the end portion thereof as well as the first embodiment. At the place of the first converting portion 14 and transfer member 24 confronting the each hole 70, the holes 60 and the holes 80 are opened respectively. The holes 60 and the holes 80 has the same shape as the first embodiment. The control member 50 is inserted into the each hole 60, 70, 80 which are confronting one another. The operation of the phase converting means comprised of the transfer member 24, the first and second converting portion 14,18 and the control member 50. The phase converting means is operated as well as the first embodiment.

The VVT controller of the fourth embodiment has a biasing member 150. The biasing member is a torsional spring 150 in this embodiment. A one end 150*a* of the torsional spring 150 is engaged with an engage hole 160 which is opened at the first converting portion 14 of the sprocket 11. The other end 150*b* of the torsional spring 150 is engaged with an engage protrusion 170 which is formed on the transfer member 24. The torsional spring 150 biases the transfer member 24 in the advance direction X according as the transfer member 24 rotates in the delay direction Y.

The operation of the fourth embodiment is described herein after.

When the electrical break or short arises in the lead 46*r*–46*t*, the load torque is transmitted as well as the first embodiment. The transfer member 24 and the output shaft 16 rotate in the advance direction X and the delay direction Y respectively, and the cam shaft 4 rotates in the delay direction Y which is the safety direction. At the same time, the side surface 80*b* presses the control member 50 by a biasing force applied from the torsion spring 150 to the transfer member 24. The control member 50 presses the side surface 60*a*,70*b* in the advance direction X and the delay direction Y respectively. Since the force pressing the side surface 70*b* in the delay direction Y is applied to the second converting portion 18 of the output shaft 16 in the delay direction Y as a biasing torque, the relative rotation of the output shaft 16 is promoted. Therefore even if the rotational phase of the cam shaft 4 is the most advanced direction in which the engine can not be started, the rotational phase is changed into the feasible phase rapidly.

In the fourth embodiment, a biasing means is comprised of the biasing member (torsional spring 150), the control member 50 and holes 60,70,80. By engaging the one end 150*b* of the torsional spring 150 with the output shaft 16, the biasing torque to the output shaft 16 is generated by the torsional spring 150.

(Fifth Embodiment)

Figure 16:
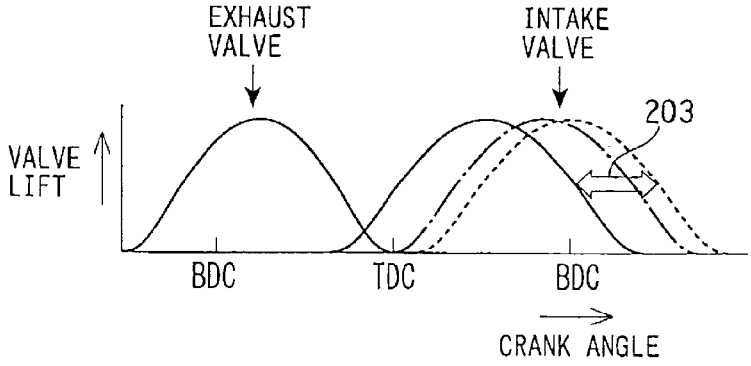
FIG. 16 is a characteristic diagram for explaining the function of the VVT controller according to the fifth embodiment.

The VVT controller of the fifth embodiment adjusts the valve timing of intake valve by varying the rotational phase of the cam shaft 4 as shown by an arrow 203 in FIG. 16. The feasible phase of the cam shaft is different from the feasible phase of the first and the fourth embodiment.

Figure 17:
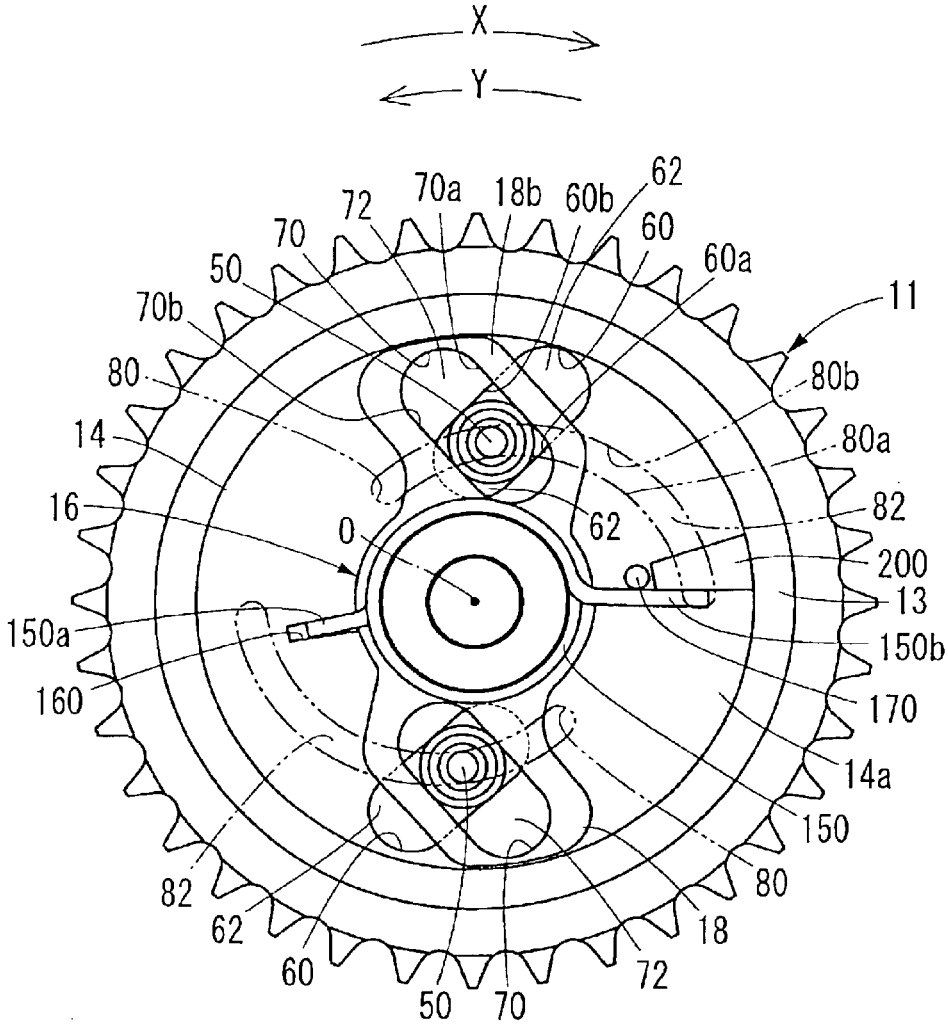
FIG. 17 is a cross sectional view of the VVT controller along a line III—III in FIG. 2 for explaining an operation according to the fifth embodiment.
Figure 18:
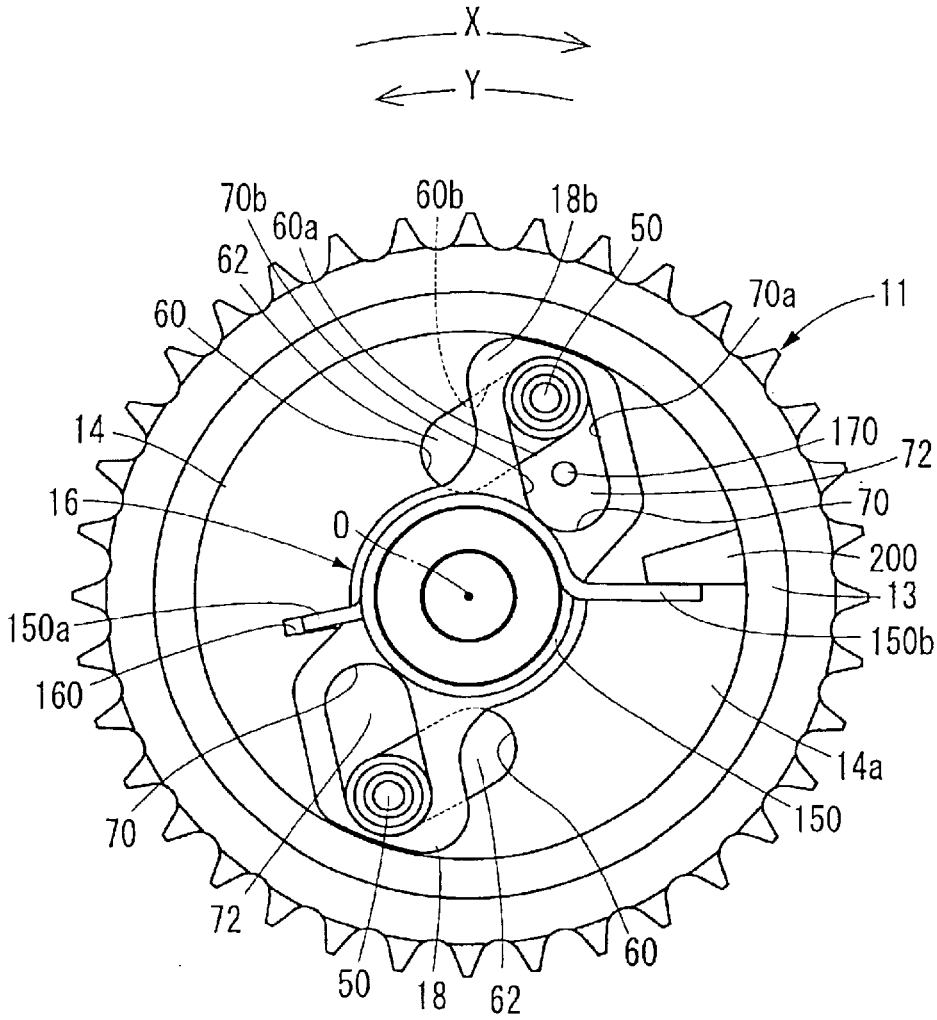
FIG. 18 is a cross sectional view of the VVT controller along a line III—III in FIG. 2 for explaining the other operation according to the fifth embodiment.
Figure 19:
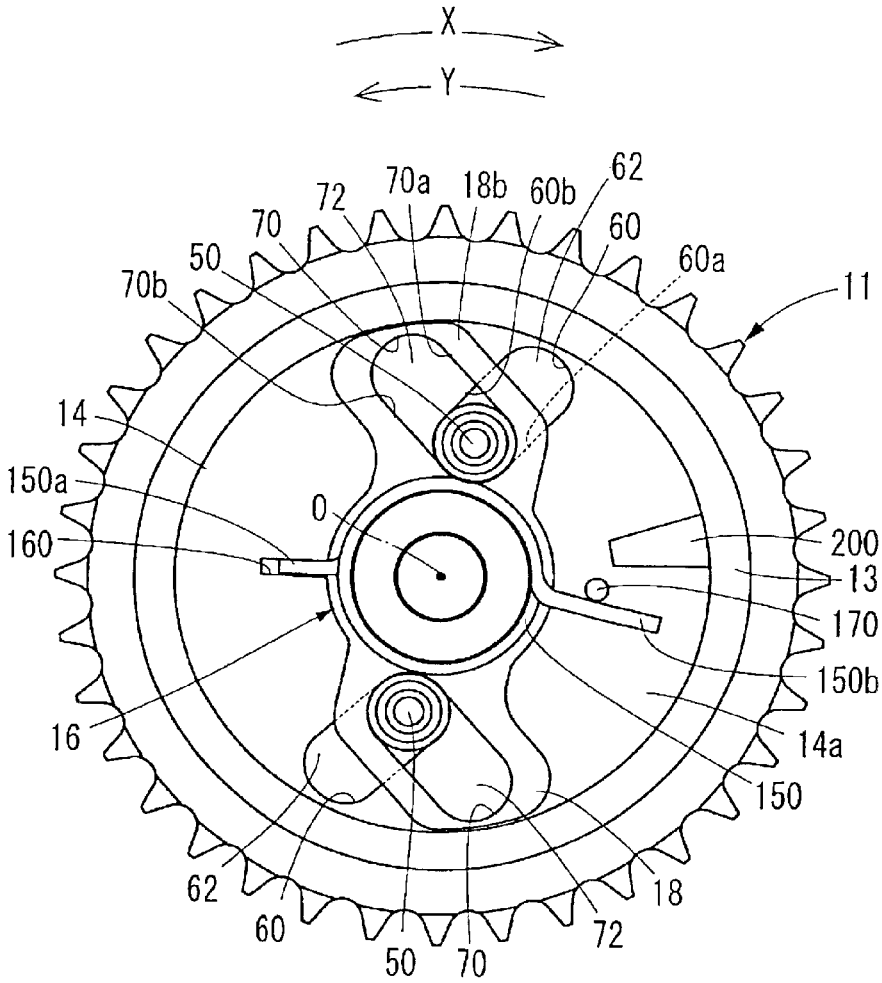
FIG. 19 is a cross sectional view of the VVT controller along a line III—III in FIG. 2 for explaining the other operation according to the fifth embodiment.

FIG. 17, FIG. 18 and FIG. 19 show the situation wherein the rotational phase of the cam shaft is in the middle phase, in the most advanced phase, and in the most delayed phase respectively. The middle phase shown in FIG. 17 is a little advanced phase than the phase shown in FIG. 19. When the cam shaft 4 is in the middle phase, the timing of the intake valve is illustrated by the dashed line in FIG. 16 and the engine can be started. In this embodiment, the middle phase is the feasible phase. On the other hand, the rotational phase of the cam shaft 4 is the most advanced phase or the most delayed phase, the valve timing of the intake valve is illustrated by the solid line in FIG. 16 and the engine can not be started.

The VVT controller of the fifth embodiment has a biasing member 150 like the fourth embodiment. When the rotational phase of the output shaft 16 is between the most advanced phase and the most delayed phase, the end 150*b* of the biasing member 150 is engaged with the engage protrusion 200. When the rotational phase of the output shaft 16 is between the most advance phase and the most delayed phase, the end 150*b* of the biasing member 150 is engaged with the protrusion 170 of the transfer member 24. The biasing member 150 biases the transfer member 24 in the delay direction Y by larger force according as the transfer member 24 rotates in the advance direction X.

The operation of the fifth embodiment is described herein after.

When the rotational phase of the output shaft 16 is between the most advanced phase and the middle phase, and when the electrical break or short arise, the load torque is transmitted as well as the first embodiment. Since the transfer member 24 and the output member 16 relatively rotate to the sprocket 11 in the advance direction and the delayed direction respectively, the rotational phase of the cam shaft 4 is changed into the delay direction. In this embodiment, the rotational phase of the cam shaft 4 is varies from the most advanced phase to the middle phase. After that, the rotational phase of the output shaft 16 reaches the middle phase, and when the rotational phase of the output shaft 16 is over the middle phase, the transfer member 24 is biased by the biasing member 150. The side surface 80*a* of the hole 80 presses the control member 50 by the force in the delay direction Y, the force being transmitted from the biasing member 150 to the transfer member 24. The control member 50 pressed the side surface 60*b*,70*a* into the delay direction and the advance direction respectively. The force pressing the side surface 70*a* in the advance direction biases the second converting portion 18 of the output shaft 16 in the advance direction X. In this embodiment, the biasing torque is larger than the torque by which the control member 50 biases the side surface 70*b* in the delay direction Y. therefore, the relative rotation of the output shaft 16 in the middle phase is restricted from further relative rotation in the delay direction Y.

When the rotational phase of the output shaft 16 is between the most advanced phase and the middle phase, and when the electrical break or short arise in the leads 46*r*–46*t*, the biasing torque is applied to the second converting portion 18. As described above, since the biasing torque is larger than the torque by which the control member 50 biases the side surface 70*b* in the delay direction Y, the output shaft 16 relatively rotates in the advance direction X. When the rotational phase of the output shaft 16 reaches the middle phase, the biasing of the transfer member 24 by the biasing member 150 is ceased. After that, when the output shaft 16 rotates in the delay direction Y by the load torque, this relative rotation of the output shaft 16 is restricted.

As described above, the rotational phase of the cam shaft 4 is transferred toward the middle phase in which the engine can be started.

In the fifth embodiment, the biasing means is comprised of the biasing member 150, the control member 150, the holes 60,70,80. By engaging the one end 150*b* of the torsional spring 150 with the output shaft 16, the biasing torque to the output shaft 16 is generated by the torsional spring 150. When the rotational phase of the output shaft 16 is in between the most advance phase and the middle phase, the biasing of the transfer member 24 by the biasing member 150 is prevented and the biasing torque is no applied to the output shaft 16. The engage protrusion 200 is of function wherein the transmission of the biasing force is stopped.

In the first, the third and the fourth embodiments, each VVT controllers controls the intake valves in the delay direction. In the second embodiment, the VVT controller controls the exhaust valve in the advance direction. In another modification, the VVT controller controls the valve timing of intake vale in the advance direction, and controls the valve timing of the exhaust valve in the delay direction, in which the engine can be started in safety.

The feature of the third embodiment can be applied to the second, fourth, and fifth embodiment. The feature of the fourth and fifth embodiment can be applied to the second embodiment.

In the first through the fifth embodiments, the breaking torque is arisen by the magnets 39 in the motor shaft 33 and is utilized as the load torque, however, the load torque can be arisen in a different way without breaking torque.

What is claimed is:

1. A variable valve timing controller for an internal combustion engine, the variable valve timing controller being disposed in a system in which the torque of a driving shaft is transmitted to a driven shaft adjusting an opening and closing timing of an intake valve and/or an exhaust valves, comprising:

a rotary shaft connected with a driving shaft;

a stator applying a torque to the rotary shaft by generating a magnetic field around the rotary shaft, the stator fixed relatively to the internal combustion engine; and a rotational phase converter converting the rotational phase of the driven shaft relatively to the driving shaft; wherein when the stator stops forming the electro magnetic field, the load torque arises on rotary shaft, and the rotational phase converter converts the rotational phase of the driven shaft toward a feasible phase in a safety direction with receiving the load torque, the feasible phase in which the internal combustion engine can be started.

2. The variable valve timing controller for an internal combustion engine according to claim 1, further comprising:

a bearing supporting the driven shaft rotatively.

3. The variable valve timing controller for an internal combustion engine according to claim 1, wherein the driving shaft has a magnet on the outer surface thereof, and the stator has a coil which forms the magnetic field around the driving shaft with being fed the current.

4. The variable valve timing controller for an internal combustion engine according to the claim 3, further comprising:

a driving circuit which is connected with a terminal of the coil and feeds a current to the coil, the driving circuit making an electrical short among the terminals when the coil stops generating the magnetic field.

5. The variable valve timing controller for an internal combustion engine according to claim 1, further comprising:

a control circuit; and a driving circuit which is electrically connected with the stator and the control circuit and feeds the current to the stator according to a signal received from the control circuit, wherein the driving circuit applies a control torque to the rotational shaft by self-controlling the feeding of current when the control signal from the control circuit is not input to the driving circuit, and the rotational phase converter varies the rotational phase of the driven shaft into a safety phase with receiving the control torque from the rotational shaft.

6. A variable valve timing controller for an internal combustion engine, the variable valve timing controller being disposed in a system in which the torque of a driving shaft is transmitted to a driven shaft adjusting an opening and closing timing of an intake valve and/or an exhaust valves, comprising:

a rotary shaft connected with a driving shaft;

a stator applying a torque to the rotary shaft by generating a magnetic field around the rotary shaft, the stator fixed relatively to the internal combustion engine; and a rotational phase converter converting the rotational phase of the driven shaft relatively to the driving shaft;

a control circuit;

a driving circuit which is electrically connected with the stator and the control circuit and feeds the current to the stator according to a signal received from the control circuit, wherein the driving circuit applies a control torque to the rotational shaft by self-controlling the feeding of current when the control signal from the control circuit is not input to the driving circuit, and the rotational phase converter varies the rotational phase of the driven shaft into a feasible phase in a safety direction with receiving the control torque from the rotational shaft.

7. The variable valve timing controller for an internal combustion engine according to one of claim 1, wherein the safety direction is a delay direction.

8. The variable valve timing controller for an internal combustion engine according to one of claim 1, wherein the safety direction is an advance direction.

9. The variable valve timing controller for an internal combustion engine according to one of claim 1, wherein the rotational phase converter has a driving rotational member rotating with the driving shaft, a driven member rotating with the driven shaft and a transmitting rotational member, the rotational phase converter varying the rotational phase by converting the relative rotational movement of the transmitting rotational member against the driving rotational member into the relative rotational movement of the driven member against the driving rotational member.

10. The variable valve timing controller according to claim 9, wherein the rotational phase converter has a biasing member for biasing the driven member, and a biasing direction is the relative rotating direction of the driven member in the safety direction.

11. The variable valve timing controller according to claim 9, wherein the rotational phase converter has a biasing member for biasing the driven member, and a biasing direction is reverse to the relative rotating direction of the driven member in the safety direction.

12. The variable valve timing controller according to claim 11, wherein the rotational phase converter has an interrupt means for interrupt the operation of the biasing force to the driven member when the rotational phase changes into the safety direction.

* * * * *